United States Patent [19]

Coronado

[11] Patent Number: 4,951,747

[45] Date of Patent: Aug. 28, 1990

[54] INFLATABLE TOOL

[75] Inventor: Martin P. Coronado, Houston, Tex.

[73] Assignee: Baker Hughes Incorporated, Houston, Tex.

[21] Appl. No.: 422,634

[22] Filed: Oct. 17, 1989

[51] Int. Cl.[5] ..... E21B 33/127

[52] U.S. Cl. ..... 166/187; 166/387

[58] Field of Search ..... 166/187, 319, 387, 317, 166/122, 378

[56] References Cited

U.S. PATENT DOCUMENTS

| | | | |
|---|---|---|---|
| 3,503,445 | 3/1970 | Cochrum et al. | 166/187 X |
| 3,575,237 | 4/1971 | Malone | 166/187 X |
| 3,604,732 | 9/1971 | Malone | 166/187 X |
| 3,606,924 | 9/1971 | Malone | 166/187 |
| 3,941,190 | 3/1976 | Conover | 166/187 |
| 4,349,204 | 9/1982 | Malone | 166/187 X |
| 4,832,120 | 5/1989 | Coronado | 166/187 |

*Primary Examiner*—Stephen J. Novosad

*Attorney, Agent, or Firm*—Hubbard, Thurman, Turner & Tucker

[57] ABSTRACT

An inflatable well tool and method of use is provided. The tool has a central body and an annular inflatable packing element. A fluid passageway transmits pressured fluid for inflation purposes. One end of the packing element is secured relative to the tubular body while the other end is selectively secured relative to such body. The inflatable means is positioned such that a pre-determined amount of axial tension must be produced in the inflatable element prior to releasing one end of the element for axial movement relative to the tubular body to provide a more uniform radial inflation of the inflatable element. The device may be repeatably utilized without retrieval to the top of the well and the inflatable element is biased to permit second inflation by resisting axial movement of the inflatable element relative to the tubular body such that second and subsequent settings of the tool in the well result in uniform inflation of the inflatable element.

5 Claims, 2 Drawing Sheets

INFLATABLE TOOL

BACKGROUND OF THE INVENTION

1. Field of the Invention:

The invention relates to an improved inflatable well tool, such as a packer or a bridge plug, for use in a subterranean well, and a method of using same.

2.Brief Description of the Prior Art:

Inflatable packers or bridge plugs have long been utilized in subterranean wells. Such inflatable tools normally comprise an elastomeric sleeve element mounted in surrounding relationship to a tubular body portion. Pressured fluid is communicated from the top of the well or interior of the well bore to the bore of the tubular body and thence through radial passages to the interior of an inner elastomeric sleeve. Such inner elastomeric sleeve may be surrounded and secured relative to a reinforcing sheath, which may be provided in the form of a plurality of peripherally overlapping, slats or ribs. Such reinforcing sheath may be formed of longitudinally extending strips which are of a suitable length so that they generally extend beyond each of the ends of the inflatable well tool with each of the longitudinally extending strips circumferentially overlapping an adjacent strip. The width of such strips and their arrangement in forming such a sheath is such that each of the strips will overlap the next adjacent strip when the inflatable member is deflated and each strip will overlap the next adjacent strip when the inflatable member is inflated, thus forming a reinforcing sheath for the inflatable element at all times.

Depending upon the use for which the inflatable member is constructed, the base material of the reinforcing sheath may be of flat braided wire impregnated with elastomer or plastic, strips of plain woven fiberglass which may or may not be impregnated with elastomer or plastic, strips of plain or woven nylon, strips of spring steel, strips of metal such as ordinary mild steel or other permanently deformable material, strips of other plain or woven material, such as teflon or other plastics, depending upon the pressure to which the inflatable member is to be inflated.

The exterior of the reinforcing sheath is either partially or completely surrounded and bonded to an outer annular elastomeric packing element of substantially greater wall thickness. Normally, an upper securing assembly wedgingly engages the upper end of the inner elastomeric sleeve with the reinforcing slats and are fixedly and sealably secured relative to the central tubular body, while a lower securing assembly is sealably secured to a sealing sub which is mounted for slidable and sealable movements on the exterior of the central tubular body, in response to the inflation forces. Such structures of this general type are shown in U.S. Pat. Nos. 3,160,211; 3,604,732; and 3,837,947.

With inflatable tools of this type, it has been observed that the upper end of the reinforced inner elastomeric sleeve was expanding prior to expansion of the packing element and becoming deformed, resulting in high local stresses. Such deformation occurs because the ends of the inner elastomeric sleeve element expand with much less pressure than the medial portions of such sleeve element which are reinforced against expansion by the thick walled elastomeric packing sleeve. Such premature expansion of the upper end of the inflatable elements of the prior art inflatable packers resulted in an inward movement of the opposite end of the elastomeric cover sleeve, forcing the inner elastomeric sleeve into sealing relationship with the exterior of the tubular central body and thus preventing passage of the pressured fluid employed for expanding the inflatable inner elastomeric sleeve from reaching the lower portions of such sleeve.

Another reason for the premature expansion of the upper end of the inner elastomeric sleeve of the inflatable packing assembly lies in the fact that any inflation movement of the lower portions of the inflatable elements results in an immediate axial displacement of the lower securing assembly relative to the stationary tubular central body. Thus, the stress in the lower portions of the packing assembly is substantially relieved by such axial movement, while the fluid pressure works on the upper portion of the inner elastomeric sleeve to deform it radially outwardly.

It has been observed that both the upper end and lower end portions of the inner sleeve expand prior to the medial portions, thus causing fluid to be trapped around the cover sleeve and between the well conduit and the casing C or uncased well bore. Subsequent leakage of such trapped fluid will permit the cover to expand, reducing the inflation pressure and setting the stage for fluid leakage past the cover element.

In U.S. Pat. No. 4,832,120, there is shown and disclosed an inflatable tool for single set within a subterranean well which incorporates one solution to this general problem. In such patent, the lower end of the inflatable packer is shear-pinned to the tubular body such that the shearable means will not release and cause the outer assembly portion of the tool which carries with it the packing component to contract relative to the tubular body until such time as a pre-determined pressure within the inflatable element is reached, thereby assuring that there is a uniform radial inflation of the inflatable element, thus overcoming the problems described above. However, such a device is not completely satisfactory for incorporation into a resettable inflatable tool, which is intended to be activated, deactivated, and reactivated a number of times during one trip of a conduit within a subterranean well, such as during the performance of remedial operations, such as acidizing and other stimulation techniques. In such resettable tools, the integrity of the inflation process of the inflatable element cannot be repeated.

The present invention addresses the problems set forth above, which occur in a well tool which is intended to be set, unset and reset within a well during one trip of the conduit carrying such tool into the well. In the case of a resettable tool, once the resettable tool has been released and moved to a new location in the hole, if the deflated element is not pulled down to the initial run-in position, it may be free to swab up and possibly prevent downward movement of the tool resulting in severe damage to the inflatable element and other components of the tool.

The present invention addresses the problems set forth above which occur in a resettable tool which can be run into the well, set, unset, and reset, all in one trip of the conduit carrying the tool into the well. The present invention also permits tension to be applied through the inflatable element to further assist in proper re-setting action.

SUMMARY OF THE INVENTION

The present invention provides an inflatable tool for use in a subterranean well bore and carryable into the well bore on a conduit such as electric or wire line, continuous tubing, workstring, production tubing, or the like. The invention is also directed to a method of using such inflatable tool in such well bore during, for example, remedial operations, such as acidizing, and other stimulation techniques.

The tool comprises a central tubular body having means at its upper end for selective engagement to the conduit. An annular inflatable packing element concentrically surrounds the central tubular body and is movable, selectively, from a deflated to an expanded position. Fluid passage means communicate between the bore of the central tubular body and the interior of the annular inflatable packing element such that pressured fluid may be transmitted from the well surface or well bore to the interior of the annular inflatable packing element to expand the inflatable packing element to expanded position and into sealing engagement with the well bore. A first securing means is engagable with one end of the inflatable packing element for sealably securing one end to the tubular body. A second securing means engages with the other end of the inflatable body element for slidably and sealably securing said other end to the central tubular body in an initial position prior to expansion of the inflatable element into sealing engagement. In one embodiment, means are provided for selectively securing the second securing means relative to the central tubular body to prevent axial movement of the second securing means and in response to inflation forces produced by the pressured fluid until a pre-selected degree of axial tension is produced in the annular inflatable packing element. Means are provided for biasing the second securing means relative to the central tubular body to resist axial movement of the second securing means in response to inflation forces produced by the pressured fluid until the pre-selected degree of axial tension is produced in the annular inflatable packing element, with the means for biasing remaining passive until the means for selectively securing the second securing means is activated to release the second securing means relative to the central tubular body with the means for biasing the second securing means also urging the second securing means in a direction away from the first securing means and to the initial position of the second securing means during deflation of the packing element.

In this manner, the well tool, which may be provided in the form of a well packer, bridge plug, tubing hanger or the like, may be run into the well on the conduit. Thereafter, pressured fluid may be introduced within the tool to inflate the inflatable element. However, the inflatable element and its component parts will not longitudinally axially move relative to the tubular housing until such time as the releasing means are disengaged at a sufficient force to assure uniform inflation, top to bottom, of the inflatable member. As this occurs, the biasing means is activated from passive mode to assure that the lower end carrying the inflatable member axially elongates relative to the tubular body during deflation, such that the tool may be moved within the well bore on the conduit and reset at a pre-determined location, either upwardly or downwardly of the initial location, and reinflation of the inflatable member can be uniformly achieved prior to and during longitudinal axial contraction of the lower end of the inflatable member relative to the tubular body.

Subsequent deflation of the inflatable element will cause elongation of the lower end of the tool for retrieval to the top of the well, or for a second resetting within the well bore.

DESCRIPTION OF THE PREFERRED EMBODIMENTS

Figure 1A:
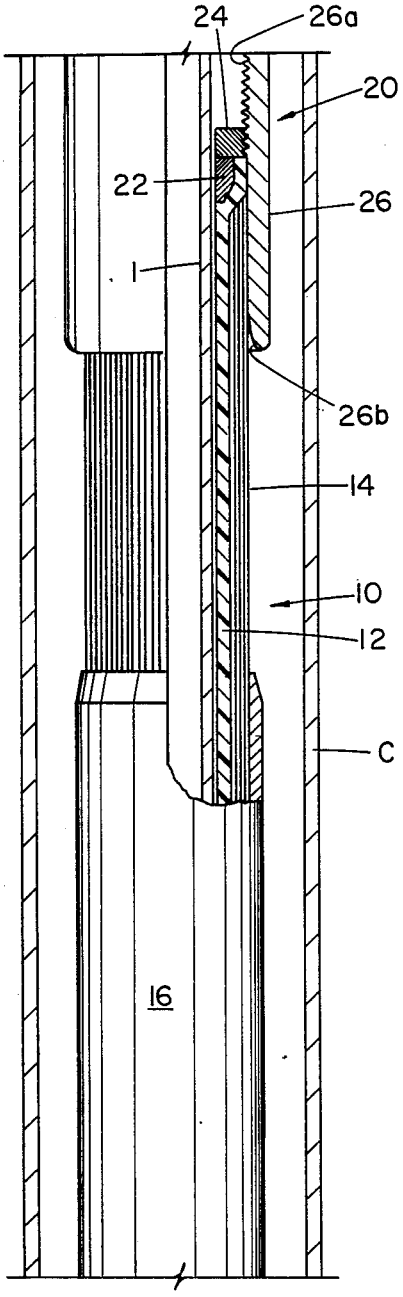
FIGS. 1A and 1B together collectively constitute a vertical quarter sectional view of an inflatable tool embodying this invention, with the elements shown in their run-in positions.
Figure 1B:
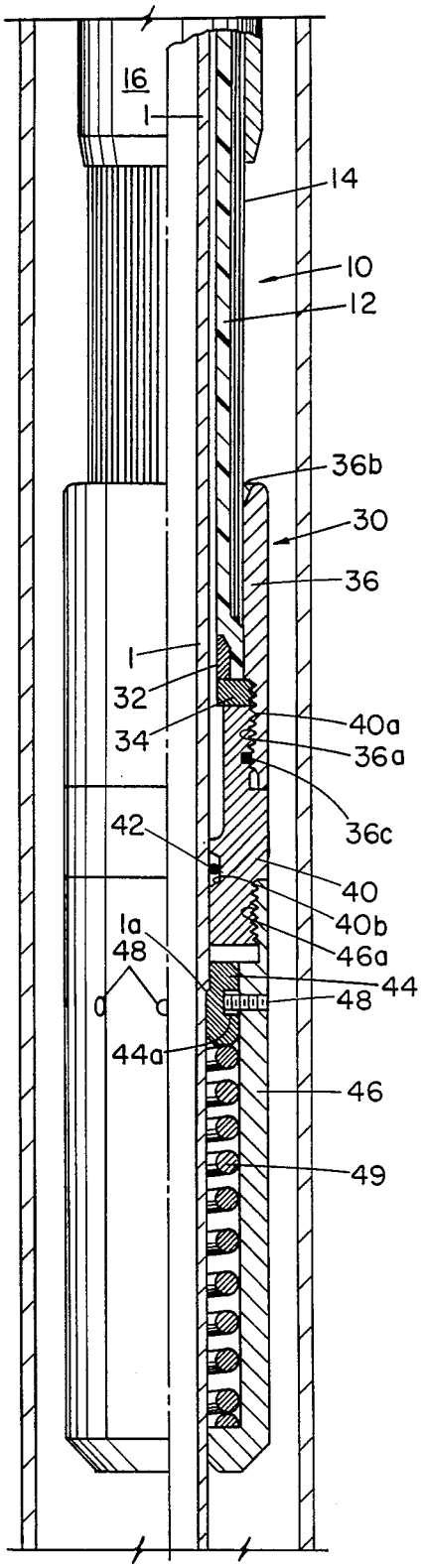

Now with reference to FIGS. 1A and 1B, there is shown the inflatable portion of an inflatable tool which can comprise a packer, bridge plug, tubing hanger or the like, depending upon whether or not the bore of the tool is open or closed.

The inflatable element 10 embodying this invention is mounted in surrounding relationship to a central body sleeve 1 which extends through the full length of the packer and connects to the bottom of a conduit, such as tubing in the form of a continuous length coiled tubing, or the like, which extends to the well surface. The conduit may also be provided in the form of wire or electric line, or sectioned, threaded drill or production pipe, or, perhaps, casing.

Inflation pressures are supplied through the bore of the body sleeve to the inflatable element in a known and conventional manner, and such procedure and components themselves do not form a particular part of the present invention, other than general background.

The inflatable element 10 comprises an inner elastomeric sleeve 12 which is disposed in surrounding relationship to the central body sleeve 1. The sleeve 12 has a reinforcing sheath shown as taking the form of a plurality of peripherally overlapping reinforcing ribs or slats 14 around its exterior and extending substantially the full length of the inflatable element 10. Alternatively, such ribs 14 may be provided in longitudinal sectioned components, the sections terminating at the packer body 16 from each of the respective ends. Each rib 14 is of arcuate cross-sectional configuration and such ribs shift relative to each other upon expansion or contraction of the sleeve 12.

The packing element 16 which actually accomplishes the sealing engagement with the bore of a well conduit or open hole C comprises an outer elastomeric sleeve or cover which is bonded or otherwise appropriately secured to a portion of or all of the reinforcing sheath 14.

An upper anchoring assembly 20 is provided for sealingly anchoring the upper ends of the elastomeric sleeve 12 and the reinforcing sheath 14 relative to the central body sleeve 1. Such anchoring assembly is of entirely conventional construction and includes a wedge element 22 which engages the top end of the inner elastomeric sleeve 12 and is forced into wedging engagement therewith by a wedged nut 24 which is engaged in internal threads **26*a* in a sleeve 26. The sleeve 26 is secured in position by being attached to the upper portion of the inflatable tool, by use of a number of conventional prior art techniques. The sleeve 26 overlies the upper ends of the reinforcing ribs 14 and has a rounded lower surface 26b to accommodate the radial expansion of the adjacent portions of the ribs 14. By virtue of such connections, the upper end of the inner elastomeric sleeve 12 and the reinforcing ribs 14 are sealably secured against axial movement relative to the central body sleeve 1**.

A lower anchoring assembly 30 is provided which is identical to the upper assembly 20 with the exception that it is in reversed relationship. Thus, a wedge 32 is forced against the lower end of the inner elastomeric sleeve 12 by an externally threaded wedge nut 34 which cooperates with internal threads 36a provided in the lower end of the clamping ring 36. The upper end of clamping ring 36 overlies the lower end of the reinforcing ribs 14 and is curved as shown at 36b to conform to the adjacent portions of ribs 14 when expansion occurs.

The clamping ring 36 is threadably secured to a seal sub 40 having external threads 40a and an elastomeric circumferentially extending O-ring seal element 36c to prevent fluid communication between the member 40 and the member 36. Such sub 40 defines an internal recess 40b within which a seal 42 is mounted which sealably engages the exterior surface of the central body sleeve 1. Extending downwardly of the seal sub 40 is a cylindrical spring housing 46 having disposed therein a power spring 49. Thus if the housing 46 is not restrained, then the lower end of the packing element 10 is free to move axially relative to the central body sleeve 1.

In one embodiment of this invention, a temporary and initial restraint is imposed upon the axial movement of the housing 46 by shearably securing such housing 46 to the central body sleeve 1. Inner body sleeve 1 is preferably provided with a downwardly facing shoulder la against which a ring 44 is abutted. The ring 44 defines an external annular groove 44a. One or more shear screws 48 are provided in radial relationship to the housing 46 and engage the annular groove 44a provided in the shear ring 44.

Figure 2A:
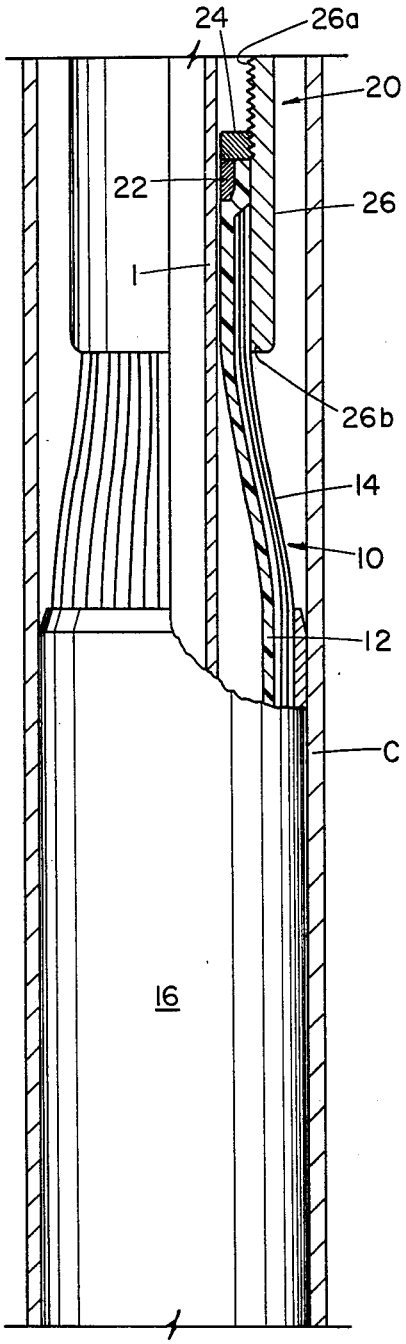
FIGS. 2A and 2B are views respectively similar to FIGS. 1A and 1B, but showing the elements of the inflatable tool in the positions occupied after the introduction of fluid to effect the expansion of the inflatable elements.
Figure 2B:
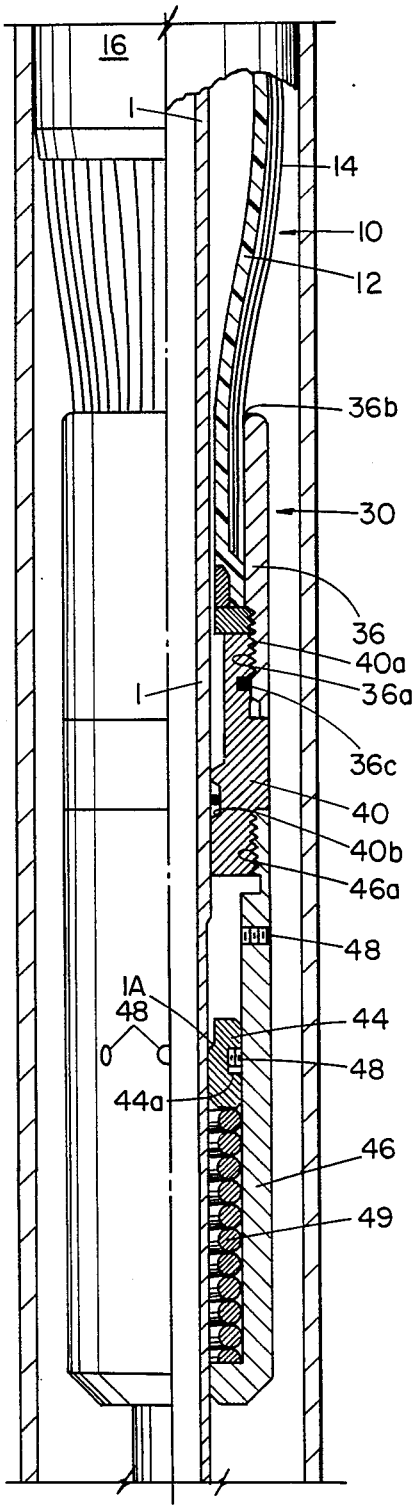

With the aforedescribed arrangement, the lower end of the inner elastomeric sleeve 12 and the reinforcing ribs 14 cannot move axially so long as the shear screws 48 are intact. Thus, the application, initially, of a pressured fluid to the inner bore of the inner elastomeric sleeve 12 produces a substantial degree of tension in such sleeve, and particularly in the reinforcing sheath or ribs 14. When this tension reaches a preselected degree capable of effecting the shearing of shear pins 48, such pins are sheared and the assembly 30 is free to move axially relative to the inner body sleeve 1, as shown in FIG. 2B. As such action occurs, a biasing means, such as the radially compressed power spring element 49 housed within the interior of the housing 46 and outwardly of the tubular body sleeve 1 will be energizingly compressed.

With this arrangement, no substantial radial expansion of the packing element 10 will occur until the desired degree of tension is produced in the reinforcing sheath or ribs 14. With such arrangement, all portions of the inflatable element 10 will expand radially outwardly at substantially the same time, thus overcoming the problems of the prior art construction enumerated above. Additionally, as the inflatable packer is deflated during unsetting, the biasing means spring 49 will expand to move the housing 46 together with the lower assembly 30 and the inflatable element downwardly to the initial run-in position. This will assist in expediting deflation and unsetting of the well tool as well as assuring that the inflatable element is in proper position to provide uniform inflation during second and subsequent setting operations.

As such second and subsequent setting operations occur, the inflation of the inflatable element will be resisted by the force defined in the spring 49 to assure uniform axial inflation of the inflatable body. The spring 49 will not prevent inflation, but will resist axial radial movement of the inflatable element to the well bore or casing for setting until the proper setting pressure is reached to assure proper and uniform setting, top to bottom.

Those skilled in the art will appreciate that, other forms of securement may be utilized between housing 46 and the central body sleeve 1, such as collets and the like. Additionally, the shear screws 48 may be replaced by a shearable ring. In any event, no substantial radial expansion of the inner elastomeric sleeve 12, the reinforcing ribs 14, and the outer elastomeric packing sleeve or cover 16 will occur until the shearable connection between the housing 46 and the central body sleeve 1 is terminated.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An inflatable tool for use in a subterranean well bore and carryable into said well bore on a conduit, comprising:

(a) a central tubular body having means on its upper end for selective engagement to said tubular conduit;

(b) an annular inflatable packing element concentrically surrounding said central tubular body and selectively movable from deflated to expanded positions;

(c) fluid passage means communicating between the bore of said central tubular body and the interior of said annular inflatable packing element, whereby pressured fluid may be transmitted to the interior of said annular inflatable packing element to expand said inflatable packing element to expanded position and into sealing engagement with said well bore;

(d) a first securing means engagable with said one end of said inflatable packing element for sealably securing said one end to said central tubular body;

(e) a second securing means engagable with the other end of said inflatable body element for slidably and sealably securing said other end to said central tubular body in an initial position prior to expansion of said inflatable element into sealing engagement;

(f) means for selectively securing said second securing means relative to said central tubular body to prevent axial movement of said second securing means in response to inflation forces produced by said pressured fluid until a pre-selected degree of axial tension is produced in said annular inflatable packing element; and (g) means for biasing said second securing means relative to said central tubular body to resist axial movement of said second securing means in response to inflation forces produced by said pressured fluid until said pre-selected degree of axial tension is produced in said annular inflatable packing element, said means for biasing remaining passive until said means for selectively securing said second securing means is activated to release said second securing means relative to said central tubular body, said means for biasing said second securing means urging said second securing means in a direction away from said first securing means and to said initial position of said second securing means during deflation of said packing element, said means for selectively securing said second securing means comprising a downwardly facing external shoulder on said central tubular body adjacent said second securing means; a stop ring surrounding said central tubular body and abutting said downwardly facing shoulder; and shearable means securing said second securing means to said stop ring.

2. The apparatus of claim 1 wherein said shearable means securing said second securing means to said stop ring comprises a sleeve threadably secured in depending relation to said second securing means and surrounding said stop ring; and a shearable element connecting said sleeve to said stop ring.

3. An inflatable tool for use in a subterranean well bore and carryable into said well bore on a conduit, comprising:

(a) a central tubular body having means on its upper end for selective engagement to said tubular conduit;

(b) an annular inflatable packing element concentrically surrounding said central tubular body and selectively movable from deflated to expanded positions;

(c) fluid passage means communicating between the bore of said central tubular body and the interior of said annular inflatable packing element, whereby pressured fluid may be transmitted to the interior of said annular inflatable packing element to expand said inflatable packing element to expand position and into sealing engagement with said well bore;

(d) a first securing means engagable with said one end of said inflatable packing element for sealably securing said one end to said central tubular body;

(e) a second securing means engagable with the other end of said inflatable body element for slidably and sealably securing said other end to said central tubular body in an initial position prior to expansion of said inflatable element into sealing engagement;

(f) means for selectively securing said second securing means relative to said central tubular body to prevent axial movement of said second securing means in response to inflation forces produced by said pressured fluid until a pre-selected degree of axial tension is produced in said annular inflatable packing element; and (g) means for biasing said second securing means relative to said central tubular body to resist axial movement of said second securing means in response to inflation forces produced by said pressured fluid until said pre-selected degree of axial tension is produced in said annular inflatable packing element, said means for biasing remaining passive until said means for selectively securing said second securing means is activated to release said second securing means relative to said central tubular body, said means for biasing said second securing means urging said second securing means in a direction away from said first securing means and to said initial position of said second securing means during deflation of said packing element, said annular inflatable packing element comprising an elastomeric sleeve covering at least a portion of a reinforcing sheath, said means for selectively securing said second securing means comprising a downwardly facing external shoulder on said central tubular body adjacent said second securing means; a stop ring surrounding said central tubular body and abutting said downwardly facing shoulder; and shearable means securing said second securing means to said stop ring.

4. The apparatus of claim 3 wherein said shearable means securing said second securing means to said stop ring comprises a sleeve threadably secured in depending relation to said second securing means and surrounding said stop ring; and a shearable element connecting said sleeve to said stop ring.

5. An inflatable tool for use in a subterranean well bore and carryable into said well bore on a conduit, comprising:

(a) a central tubular body having means on its upper end for selective engagement to said tubular conduit;

(b) an annular inflatable packing element concentrically surrounding said central tubular body and selectively movable from deflated to expanded positions;

(c) fluid passage means communicating between the bore of said central tubular body and the interior of said annular inflatable packing element, whereby pressured fluid may be transmitted to the interior of said annular inflatable packing element to expand said inflatable packing element to expanded position and into sealing engagement with said well bore;

(d) a first securing means engagable with said one end of said inflatable packing element for sealably securing said one end to said central tubular body;

(e) a second securing means engagable with the other end of said inflatable body element for slidably and sealably securing said other end to said central tubular body in an initial position prior to expansion of said inflatable element into sealing engagement;

(f) means for selectively securing said second securing means relative to said central tubular body to prevent axial movement of said second securing means in response to inflation forces produced by said pressured fluid until a pre-selected degree of axial tension is produced in said annular inflatable packing element; and (g) means for biasing said second securing means relative to said central tubular body to resist axial movement of said second securing means in response to inflation forces produced by said pressured fluid until said pre-selected degree of axial tension is produced in said annular inflatable packing element, said means for biasing remaining passive until said means for selectively securing said second securing means is activated to release said second securing means relative to said central tubular body, said means for biasing said second securing means urging said second securing means in a direction away from said first securing means and to said initial position of said second securing means during deflation of said packing element, said annular inflatable packing element comprising an elastomeric sleeve covering at least a portion of a reinforcing sheath, said annular inflatable packing element comprising an elastomeric sleeve having peripherally overlapped, axially extending reinforcing ribs secured relative to the exterior of said elastomeric sleeve; and an elastomeric cover sleeve secured to at least the medial portion of said reinforcing ribs, whereby the end portions of said elastomeric sleeve and said ribs are subjected to said pre-selected degree of axial tension to prevent radial expansion of one end of said elastomeric sleeve prior to the other end, said means for selectively securing said securing means comprising a downwardly facing external shoulder on said central tubular body adjacent said second securing means; a stop ring surrounding said central tubular body and abutting said downwardly facing shoulder; and shearable means securing said second securing means to said stop ring.

* * * * *